US006253732B1

(12) United States Patent
Semeyn, Jr. et al.

(10) Patent No.: US 6,253,732 B1
(45) Date of Patent: Jul. 3, 2001

(54) ELECTRONIC THROTTLE RETURN MECHANISM WITH A TWO-SPRING AND TWO-LEVER DEFAULT MECHANISM

(75) Inventors: Mark Warner Semeyn, Jr., Ypsilanti; Joseph John LaRussa, Dearborn; Mark Alan Saunders, Saline, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/438,161

(22) Filed: Nov. 11, 1999

(51) Int. Cl.[7] ..... F02D 9/10
(52) U.S. Cl. ..... 123/396; 251/129.12
(58) Field of Search ..... 123/396, 398, 123/399, 361; 251/129.02, 129.11, 129.12

(56) References Cited

U.S. PATENT DOCUMENTS

| | | |
|---|---|---|
| 2,924,424 | 2/1960 | Tittering . |
| 3,924,596 | 12/1975 | Klemm et al. . |
| 4,008,877 | 2/1977 | Yasuoka et al. . |
| 4,601,271 | 7/1986 | Ejiri et al. . |
| 4,827,884 | 5/1989 | Cook . |
| 4,838,226 | 6/1989 | Matsuzawa et al. . |
| 4,848,505 | 7/1989 | Yoshizawa et al. . |
| 4,873,954 | 10/1989 | Codling . |
| 4,879,657 | 11/1989 | Tamura et al. . |
| 4,892,071 | 1/1990 | Asayama . |
| 4,947,815 | 8/1990 | Peter . |
| 4,961,355 | 10/1990 | Irino et al. . |
| 4,986,238 | 1/1991 | Terazawa . |
| 4,991,552 | 2/1991 | Luft et al. . |
| 5,014,666 | 5/1991 | Westenberger . |
| 5,018,496 | 5/1991 | Buchl . |
| 5,038,733 | 8/1991 | Westenberger . |
| 5,078,110 | 1/1992 | Rodefeld . |
| 5,103,787 | 4/1992 | Bassler et al. . |
| 5,113,822 | 5/1992 | Asayama . |
| 5,148,790 | 9/1992 | Hickman et al. . |
| 5,161,508 | 11/1992 | Zentgraf et al. . |
| 5,168,852 | 12/1992 | Moriguchi et al. . |
| 5,168,951 | 12/1992 | Sugiura et al. . |
| 5,259,349 | 11/1993 | Radinski . |
| 5,265,572 | 11/1993 | Kadomukai et al. . |
| 5,275,375 | 1/1994 | Semence . |
| 5,297,521 | 3/1994 | Sasaki et al. . |
| 5,297,522 | 3/1994 | Buchl . |
| 5,325,832 | 7/1994 | Maute et al. . |
| 5,423,299 | 6/1995 | Kumagai . |
| 5,429,090 | 7/1995 | Kotchi . |
| 5,429,097 | 7/1995 | Wojts-Saary et al. . |
| 5,630,571 | 5/1997 | Kipp et al. . |
| 5,752,484 | 5/1998 | Apel et al. . |
| 5,775,292 | 7/1998 | Seeger . |
| 5,938,858 | * 11/1999 | Hashimoto et al. ..... 123/396 |
| 5,975,051 | * 11/1999 | Yamada et al. ..... 123/396 |

FOREIGN PATENT DOCUMENTS

| | | |
|---|---|---|
| 1-239-533 | 4/1967 | (DE) . |
| 40 39 937 | 6/1992 | (DE) . |
| 41 41 104 | 6/1993 | (DE) . |
| 0 574 093 | 6/1991 | (EP) . |
| 651147 | 9/1994 | (EP) . |
| 2217 389 | 10/1989 | (GB) . |
| 2 233 038 | 1/1991 | (GB) . |
| 64-24129 | 1/1989 | (JP) . |
| 2-70932 | 9/1990 | (JP) . |

* cited by examiner

*Primary Examiner*—Andrew M. Dolinar
(74) *Attorney, Agent, or Firm*—Jerome R. Drouillard

(57) ABSTRACT

An electronic throttle control system having a housing 22 with a motor 40, throttle valve 60, gear mechanism 100, and failsafe mechanism. The failsafe mechanism comprises two springs 130, 150 and two levers 140, 160 which are used in combination with a gear member and an adjustable stop screw 170 on the housing.

16 Claims, 5 Drawing Sheets

ELECTRONIC THROTTLE RETURN MECHANISM WITH A TWO-SPRING AND TWO-LEVER DEFAULT MECHANISM

CROSS-REFERENCE TO RELATED APPLICATIONS

The present application is related to the following three patent applications which are co-owned by the same assignee and filed on the same date herewith: "Electronic Throttle Control System With Two-Spring Failsafe Mechanism," U.S. Pat. No. 6,173,939 B1; "Electronic Throttle Return Mechanism With Default and Gear Backlash Control," Ser. No. 09/438,576; and "Electronic Throttle Return Mechanism With a Two-Spring and One Lever Default Mechanism," Ser. No. 09/438,162. The disclosures of each of these three other patent applications are being incorporated by reference herein.

TECHNICAL FIELD

This invention relates to electronic valve control systems and more particularly to an electronic throttle control system for an internal combustion engine.

BACKGROUND

Valve assemblies for engines and related systems typically utilize rotatable valve members in fluid flow passageways to assist in regulating fluid flow through them. For example, throttle valve members are positioned in the air induction passageways into internal combustion engines. The valve assemblies are controlled either mechanically or electronically and utilize a mechanism which directly operates the valve member.

For electronic throttle control systems, it is desirable to have a failsafe mechanism or system which activates the throttle valve in the event that the electronic control or electronic system of the vehicle fails. There are known electronic throttle control systems which have failsafe mechanisms for closing the throttle valve or moving it to a slightly open position in the event of an electronic failure in the vehicle. Some of these mechanisms utilize one, two or more spring members in order to activate the failsafe system.

It would be desirable to have an electronic valve control system with an improved failsafe or limp-home mechanism and which provides an improved assembly and system with reduced cost and improved reliability.

SUMMARY OF THE INVENTION

The present invention provides an electronic throttle control assembly having a housing with a motor, a gear train and throttle valve. A throttle plate is positioned on a throttle shaft and the plate and shaft are positioned in the engine or air induction passageway, such that the throttle plate regulates airflow into the engine.

The operation of the throttle valve is accomplished by a gear train assembly driven by a reversible DC motor. The motor is regulated by the electronic control unit of the vehicle which in turn is responsive to the input of the vehicle operator or driver. A throttle position sensor is included in a housing cover and feeds back the position of the throttle plate to the electronic control unit.

In the operation of the throttle valve, a gear connected to the motor operates an intermediate gear, which in turn operates a sector gear which is connected to the throttle body shaft. The sector gear is biased by a main spring member towards the closed position of the throttle valve. Two lever members and two spring members are provided, all in operational association with the sector gear member. The two lever members, namely a main lever member and a default lever member, are free to rotate on the throttle shaft. A main spring member is positioned between and connected to the sector gear member and the main lever member. A default spring member is positioned between the main lever member and the default lever member.

The main spring member is grounded between the sector gear member and the main lever member. The main lever member is grounded to the housing through an adjustment screw stop member. The default spring member is grounded between the two levers.

In the event of an electronic failure during operation of the vehicle with the throttle valve in an open position, the main spring member will return the throttle valve to the default or failsafe position. The mechanism will stop at a prescribed default angle since the intermediate gear contacts the default lever and is prevented from further rotation by the default spring member.

If the throttle valve is in its closed position when an electronic failure occurs, the default spring, acting on the default lever and intermediate gear post member, rotates the intermediate gear, in turn rotating the sector gear to open the throttle valve slightly to a failsafe position. The force of the default spring is greater than that of the main spring member. At the failsafe position, the vehicle can still be operated, although at a reduced capacity. This allows the driver to "limp-home."

The default adjustment screw can be used to change the angle of the throttle valve at the default position. Also, the two lever members and sector gear preferably are snap fit together for each assembly.

Other features and advantages of the present invention will become apparent from the following description of the invention, particularly when viewed in accordance with the accompanying drawings and appended claims.

DESCRIPTION OF THE PREFERRED EMBODIMENT(S)

Figure 1:
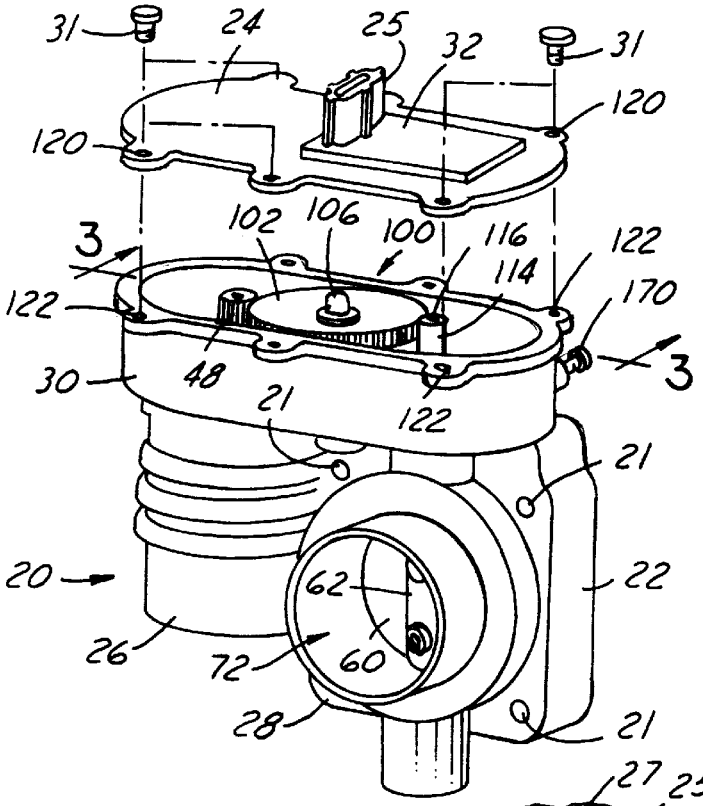
FIG. 1 illustrates an electronic throttle control assembly in accordance with the present invention.
Figure 3:
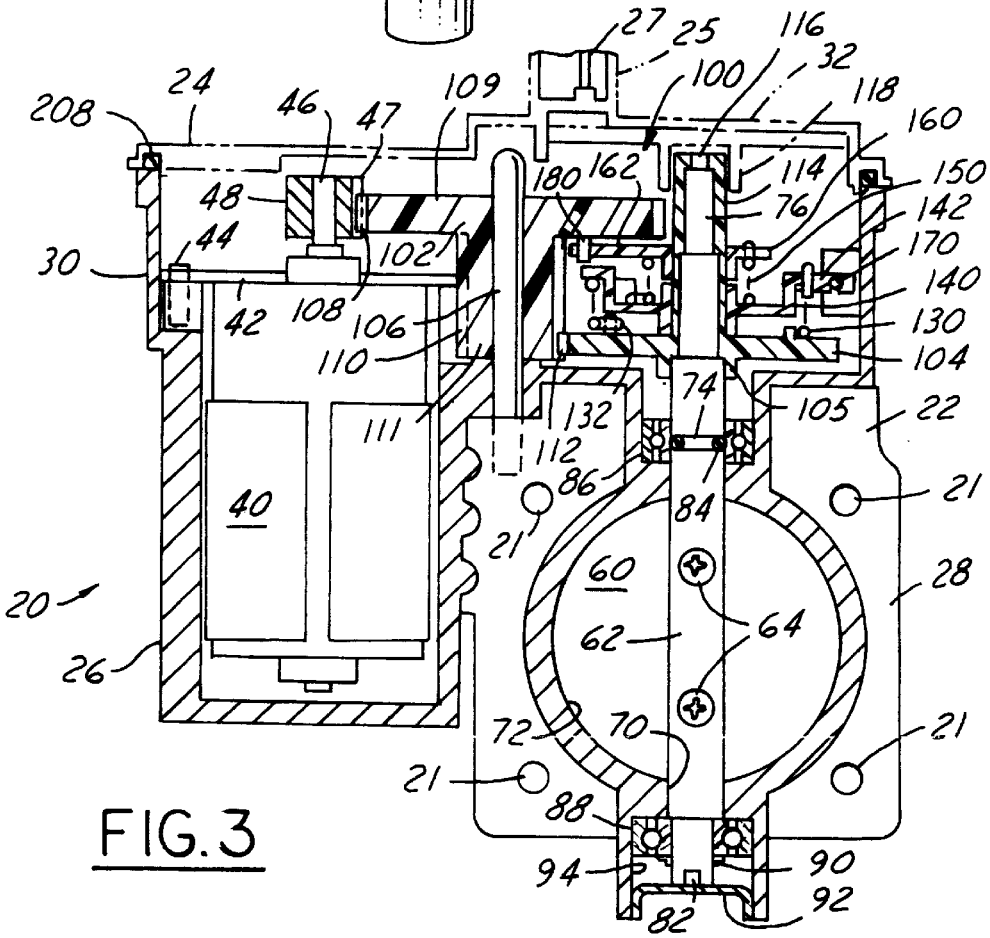
FIG. 3 is a cross-sectional view of the electronic throttle control assembly of FIG. 1, the cross-section being taken along line 3—3 in FIG. 1 and in the direction of the arrows.
Figure 2:
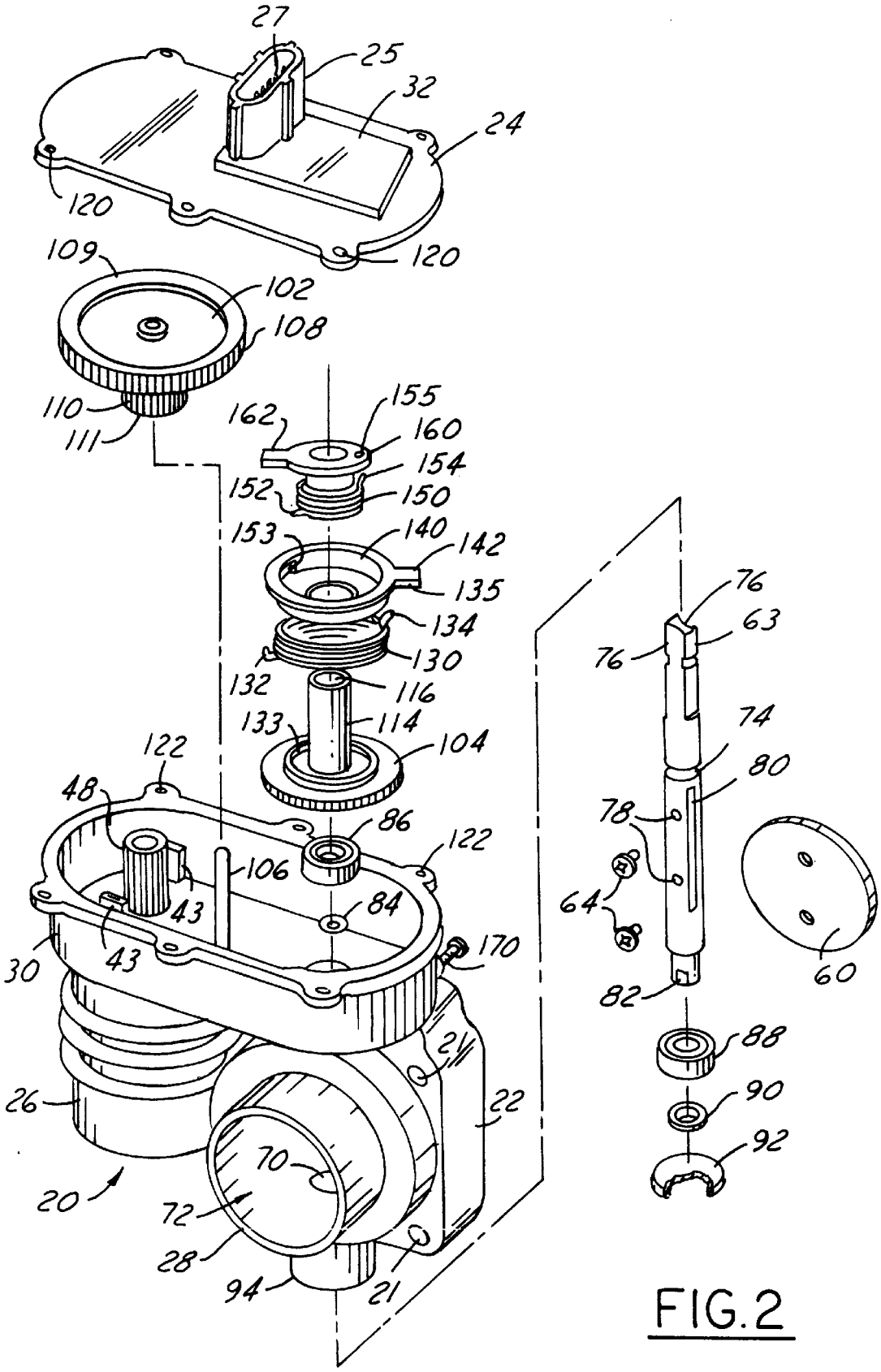
FIG. 2 is an exploded view of the electronic throttle control assembly of FIG. 1.
Figure 4:
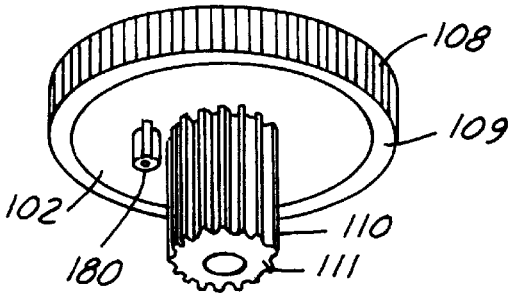
FIG. 4 depicts an intermediate gear member which can be utilized with the present invention.

FIGS. 1–3 illustrate a preferred embodiment of an electronic throttle control assembly in accordance with the present invention, while FIGS. 4–10 illustrate various components of the assembly and the operation thereof. As to FIGS. 1–3, FIG. 1 illustrates the assembly 20 in its assembled form (with the cover removed for clarity), FIG. 2 illustrates the components of the assembly in an exploded condition, and FIG. 3 is a cross-sectional view of the assembly 20 as shown in FIG. 1.

The electronic throttle control assembly 20 includes a housing or body member 22 and a cover member 24. The housing 22 includes a motor section 26, a throttle valve section 28, and a gear train section 30. The cover member 24 includes the throttle position sensor (TPS) 32, together with related electronics, which reads or "senses" the position of the throttle valve and transmits it to the electronic control unit (ECU) 200 of the vehicle (see FIG. 11). In order to connect the ECU to the TPS, an electrical connector member 25 is positioned on the cover member 24. The connector member preferably has six contacts 27: two to the motor 40 which regulates the position of the throttle valve; and four to the TPS and related electronics.

When the driver or operator of the vehicle presses the vehicle accelerator, the electronic control unit (ECU) sends a signal to the motor 40 which in turn operates the gear train 100 and adjusts the position of the throttle valve 60. The throttle valve is positioned in the main air passageway 72 from the air intake inside the engine compartment to the internal combustion engine. The precise position of the throttle valve in the airflow passageway is sensed by the TPS and relayed or fed back to the ECU in order to confirm or adjust the desired throttle valve setting. The throttle valve thus regulates the airflow to the internal combustion engine and in turn the speed of the engine and velocity of the vehicle.

The cover member can be attached to the body member 22 in any conventional manner, but preferably is connected by a plurality of fastener members, such as screws or bolts 31. For this purpose, a series of openings 120 are provided in the cover member for mating with a series of sockets 122 on the gear section 30 of the housing 22. The sockets 122 can be threaded in order to securely hold the cover in place or threaded nuts could be utilized. Also, an appropriate gasket or sealing member 208 can be positioned between the cover member and the housing in order to protect the gear train and TPS from dirt, moisture and other environmental conditions (see FIG. 3). When the electronic throttle control assembly 20 is utilized, it is positioned in the engine compartment of the vehicle and bolted or otherwise securely fastened to the vehicle. For this purpose, a plurality of holes 21 are provided in the housing.

The motor 40, as best shown in FIG. 3, is preferably a reversible thirteen volt DC motor although other conventional comparable motors can be utilized. The motor 40 is connected to a mounting plate 42 which is bolted or otherwise securely fastened to the body member 22 by a plurality of bolts, screws, or other fasteners 44. The plate 42 also has a pair of contacts 43, as shown in FIG. 2, which electrically connect the electronics in the cover member 24 to the motor 40.

The motor 40 has a shaft 46 on which a small spur gear 48 is positioned. The gear 48 has a plurality of teeth 47 which mesh with and rotate adjacent gears, as described below. The throttle valve or plate 60 is secured to a throttle body shaft 62 which in turn is positioned in the throttle section 28 of the body member or housing 22. The throttle plate 60 is secured to the throttle body shaft 62 by a plurality of small fasteners or plate screws 64. The throttle shaft 62 is positioned in a bore or channel 70 in the throttle section of the body member 22. The bore 70 is transverse to the axis of the air flow passageway 72.

Throttle shaft 62 has an O-ring channel or groove 74, a pair of flats or recesses 76 at the upper end for connection to one of the gears (as explained below), a pair of openings 78 for positioning of the plate screws therethrough, an axial or longitudinally extending slot 80 for positioning of the throttle plate 60 therein, and a pair of flats or recesses 82 at the lower end for use in assembling and positioning the throttle valve. The flats 82 are utilized to rotate the throttle shaft 62 during assembly of the throttle plate and also for orientation of the sector gear during the molding or attachment process.

An O-ring 84 is positioned in the channel 74 on the throttle shaft. The O-ring 84 provides a seal between the air in the air flow passageway 72 and the gear train components and electronics in the cover. For assembly of the throttle body shaft and throttle plate in the assembly 20, the throttle body shaft 62 is first positioned in the bore 70 and rotated in order to allow the plate 60 to be positioned in slot 80. The throttle body shaft 62 is then turned approximately 90 degrees in order to allow the throttle plate screws 64 to be secured through the shaft and plate, thereby securely affixing the plate to the shaft.

When the throttle body shaft 62 is positioned in the housing 22, a pair of bearings 86 and 88 are provided to allow the throttle body shaft to rotate freely in the housing. The bearings 86 and 88 are conventional ball-bearing members with pairs of races separated by small balls.

As shown in FIG. 3, once the throttle body shaft 62 is positioned in the body member 22 (and before the throttle plate 60 is secured to it), an axial retainer clip member 90, preferably made of a spring steel material, is secured to the lower end of the shaft. The retainer clip member 90 holds the throttle body shaft 62 securely in position in the throttle section 28 of the body or housing member 22 and minimizes axial or longitudinal movement (or "play") of the shaft 62 in the housing.

During assembly, the clip member 90 is pushed or forced onto the shaft 62 until it contacts the inner race of bearing 88. The throttle body shaft, being stepped in diameter, is then fixed axially to the inner race of the bearing. A spring clip member could also be utilized in order to pre-load the bearings to minimize radial movement of the shaft and also minimize axial movement of the shaft in the assembly 22.

Once the retainer clip member 90 is installed in position and the throttle plate is attached to it, an end cap member or plug member 92 is positioned enclosing the cavity 94. This protects the lower end of the shaft from moisture, dirt and other environmental conditions which might adversely affect the operation of the throttle valve. The step is typically the last step in the assembly process since the end of the shaft 62 is left exposed until after all end-of-the-line testing has been completed.

Figure 5:
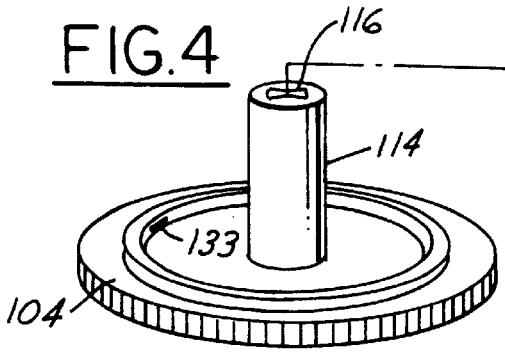
FIG. 5 illustrates the sector gear member, two lever members and two spring members which can be utilized with the present invention.
Figure 5:
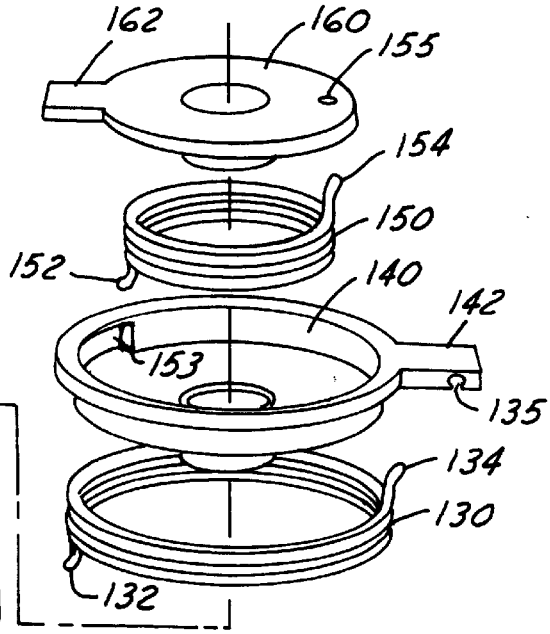

The gear assembly or gear train mechanism used with the electronic control assembly 20 in accordance with the present invention is generally referred to by the reference numeral 100. The gear train mechanism 100 includes spur gear 48 attached to motor 40, an intermediate gear member 102 (FIG. 4), and a sector gear member 104 (FIG. 5). The intermediate gear member 102 is mounted on a shaft member 106 which is secured to the housing or body member 22 (see FIGS. 1–3). The intermediate gear member 102 rotates freely on shaft 106.

The intermediate gear member 102 has a first series of gear teeth 108 on a first portion 109 and a second series of gear teeth 110 on a second portion 111. The gear teeth 108 on gear 102 are positioned to mesh with the gear teeth 47 on the motor driven gear 48, while the gear teeth 110 are positioned and adapted for mating with the gear teeth 112 on the sector gear 104. As shown in the drawings, the teeth 112 on gear 104 are only provided on a portion or sector of the outside circumference of the gear member.

All of the gear members 48, 102 and 104 are preferably made of a plastic material, such as nylon, although they can be made of any other comparable material, or metal, which has equivalent durability and function.

The sector gear 104 is preferably molded onto the end 63 of the throttle body shaft 62. For this purpose, recesses 76 are provided on the shaft 62 to allow the sector gear to be integrally molded to the shaft and be permanently affixed thereto. Also, the lower part 105 of the sector gear can be extended in order to contact the inner race of bearing 86, thus helping to hold the throttle body shaft axially in position.

The sector gear 104 has a central portion or member 114 which extends above the gear train 100 for communication with the throttle position sensor (TPS) mechanism 32 in the cover member 24. In order for the TPS to read the position of the throttle valve plate 60, the TPS must be able to correctly sense or read the movement and rotation of the throttle body shaft 62.

For this purpose, two opposing flats are positioned on the upper end of the central member 114. The hub of the TPS is press-fit onto these flats and thus the position of the throttle shaft can be read accurately without relative movement between the TPS and the shaft.

If desired, a socket member 118 could be provided on the cover member 24 in order to fit over the upper end of the central portion 114 of the sector gear (see FIGS. 3 and 12). The socket member 118 comes in close proximity to the default lever, limiting its axial movement.

In the operation of the electronic throttle valve assembly, the force applied to the accelerator pedal 120 by the operator of the vehicle 122 is read by a sensor 124 and conveyed to the ECU 200 (see FIG. 11). The accelerator pedal 120 is typically biased by a spring-type biasing member 126 in order to provide tactile feedback to the operator. The ECU of the vehicle also receives input from a plurality of other sensors 128 connected in other mechanisms and systems in the vehicle.

In order to operate the throttle valve plate 62, a signal from the ECU 200 is sent to the motor 40. The motor rotates the spur gear 48 which then operates the gear train mechanism 100. More specifically, the gear member 48 rotates the intermediate gear member 102, which in turn rotates the sector gear member 104. This in turn causes the throttle body shaft 62, which is fixedly attached to the gear member 104, to rotate. Rotation of shaft 62 accurately positions the valve plate 62 in the passageway 72 and allows the requisite and necessary air flow into the engine in response to movement of the accelerator pedal 120.

The present invention also has a default or failsafe (a/k/a "limp-home") mechanism which allows the throttle valve plate to remain partially open in the event of a failure of the electronics system in the throttle control mechanism or in the entire vehicle. The default mechanism of the present electronic throttle control assembly 20 includes a main spring member 130, a main lever member 140, a default spring member 150, and a default lever member 160. The default mechanism also includes an adjustment screw 170 and operates in association with the sector gear member 104 and the intermediate gear member 102.

The main lever member 140 and default lever member 160 are positioned on central member 114 of the sector gear member 104 and are able to rotate around the central member 114. The main spring member 130 and default spring member 150 are also positioned around the central member 114. The main spring member is attached at one end 132 to the main lever member 140. Slots or openings 133 and 135 are provided in the sector gear member and main lever member, respectively, for this purpose.

The default spring member 150 is attached to one end 152 of the main lever member 140 and attached at the other end 154 to the default lever member 160. Slots or openings 153 and 155 are provided for this purpose in the main lever member and default lever member, respectively.

The stop screw member 170 is threadedly positioned in wall or shoulder 172 in the housing 30. The screw 170 can be rotated or turned in any conventional manner in order to change or adjust the end 174 which acts as a stop for the main lever member of the default mechanism.

The main lever member 140 has an extending arm member 142 which is positioned in the housing in order to act in cooperation with the stop screw member 170. A slot or channel 135 is provided in the arm member for this purpose. The default lever member 160 also has an extending arm member 162. The arm member 162 is positioned to come into contact with post member 180 on the intermediate gear member 102 when the intermediate gear member is rotated by the motor and gear 48.

The default mechanism, in combination with the intermediate gear 102 and sector gear 104 acts to limit and control the operation of the valve plate member 60 and the failsafe mechanism.

Figure 6:
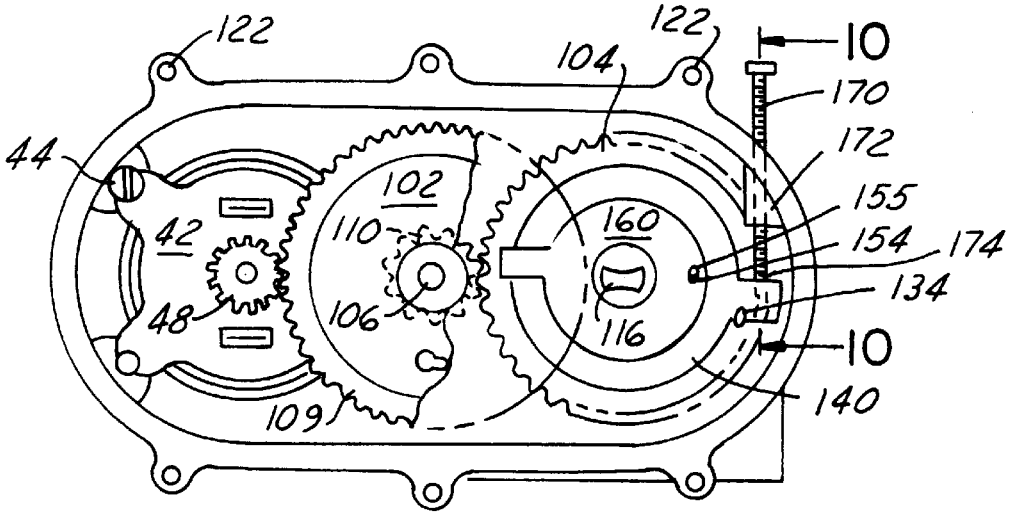
FIGS. 6, 7, and 8 illustrate the range of operation of the gear train in accordance with one embodiment of the present invention.
Figure 6A:
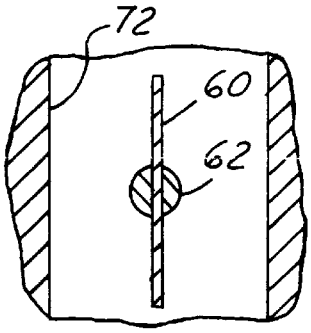
FIGS. 6A, 7A and 8A illustrate various positions of the throttle valve plate during the range of operation of the present invention.

The main spring member 130 biases the valve plate member 60 towards its closed position. When the shaft member 62 and sector gear member 104 are rotated by the motor 40 and gear train mechanism 100 to the fully open position of the throttle plate 60, as shown in FIGS. 6 and 6A, the main spring member 130 is biased to return the valve or throttle plate member 60 to or towards the closed position. In the fully open position, the throttle plate 60 is positioned approximately parallel with the axis of the passageway 72 thus allowing a full compliment of air to pass into the engine. In this manner in the event of an electronic failure in the throttle control assembly 20 when the throttle valve is open (i.e., when the accelerator pedal is depressed and the vehicle is moving at a significant velocity), the failsafe or default mechanism will automatically act to close the throttle valve in order to reduce the speed of the engine and the velocity of the vehicle.

The main spring member 130 returns the throttle to the default position in the event of an electronic failure. The throttle valve plate will stop at the default position due to contact of the arm member 162 with the post member 180. In this regard, the precise position of the default angle of the throttle plate member can be adjusted by adjustment of the position of the end 174 of the screw 170. The stop screw adjusts the angle of the main lever, which in turn adjusts the angle of the default lever. Slot or channel 135 on the main lever 140 keeps the lever at a fixed position once it is adjusted.

In order for the throttle valve to proceed beyond the default position to the fully closed position (a/k/a "closed-in-bore" position), the force of the default spring member 150 must be overcome. This is accomplished by further rotation of intermediate gear 102 by the motor 40 which in turn causes post member 180 to contact arm member 162 on the default lever member. Rotation of the default lever in turn causes the sector gear member 104 to also rotate through the spring members 130 and 150 and in turn rotate the throttle valve plate member 60 in the air conduit 72.

Figure 7:
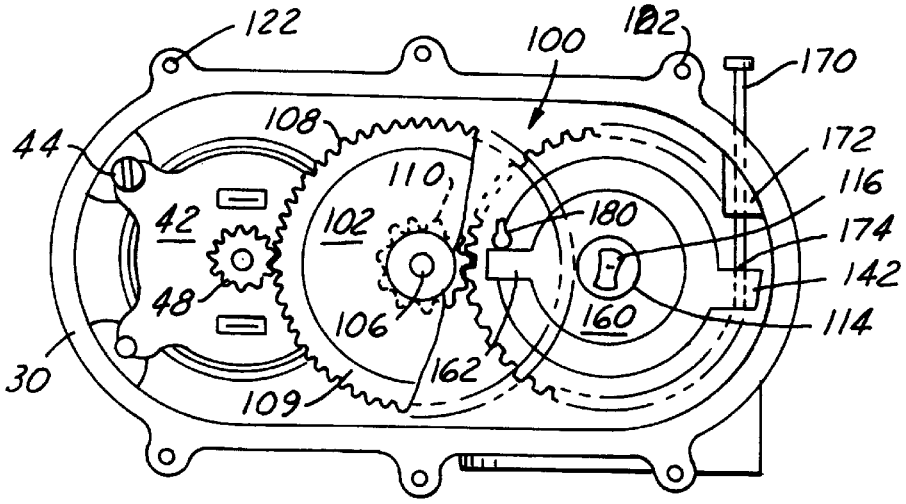
Figure 7A:
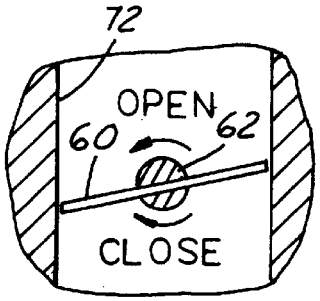
Figure 8:
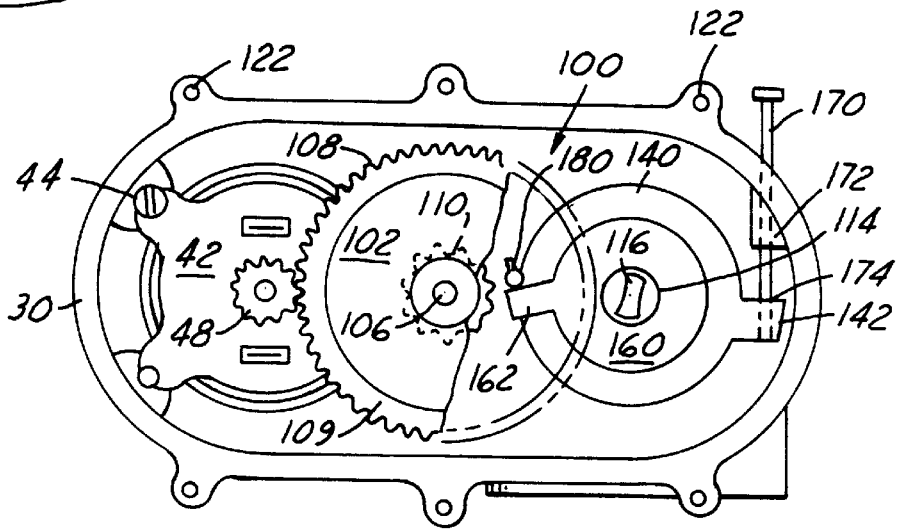
Figure 8A:
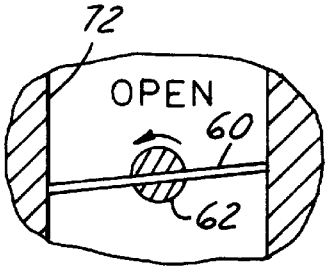
Figure 9:
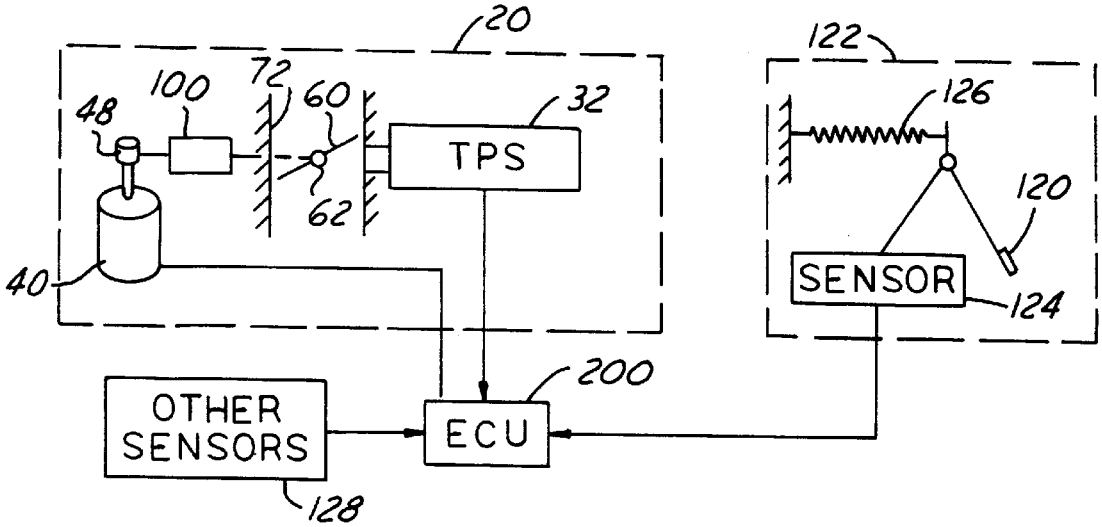
FIG. 9 is a schematic illustration showing a representative circuit which can be utilized with the present invention.
Figure 10:
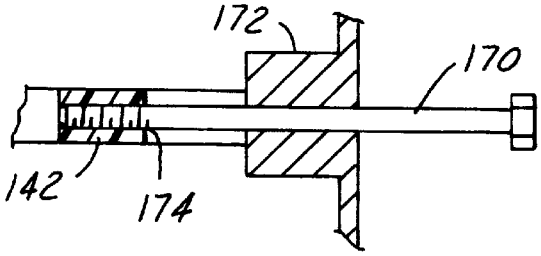
FIG. 10 illustrates an additional feature of the invention.

The position of the gear members and lever members at the default position are shown in FIG. 7. The position of the throttle valve plate member 60 in the default position is shown in FIG. 7A. The position of the gear members and lever members at the closed-in-bore position are shown in FIG. 8. The position of the throttle valve plate member 60 in the fully closed position is shown in FIG. 8A.

When the valve or throttle plate member is in the default position, it is opened about 5°–10° from the throttle valve's closed position. In many engines known today, the throttle plate is manufactured and assembled to have a slight inclination on the order of 70°–10° in the fully closed position. This is to assure proper functioning of the valve plate in all conditions and prevent it from sticking or binding in the closed position. Thus, in the default or "limp-home" position, the throttle plate will be about 12°–20° from a position transverse to the axis of the air flow passageway.

In the event of an electronic failure in the throttle control assembly 20 when the throttle plate member is closed or almost closed, the failsafe mechanism will automatically act to open the throttle plate to the default or "limp-home" position. The force of the default spring member 150 on the main lever member 140 and in turn on the sector gear member 104 will force the sector gear member 104 (and throttle shaft member 62) to rotate slightly and open the throttle valve. In this regard, the force of the default spring member 150 is stronger or greater than the force of the main spring member 130.

In the failsafe position of operation, the throttle plate 60 is at a slightly opened position, as shown in FIG. 7A. In such a position, the throttle valve allows some air to flow through the passageway 72, thus allowing the engine sufficient inlet air in order to operate the engine and for the vehicle to "limp-home".

With the use of two springs 130 and 150, the throttle shaft member 62 (and thus the throttle valve plate member 60) is biased in all directions of operation of the throttle control valve system toward the default or limp-home position.

The components of the fail-safe mechanism can be assembled together as a sub-assembly to aid in their installation into the gear train section 30 of the housing 22. In this regard the sector gear 104, main lever member 140 and default lever member 160 can be snap-fit together into a sub-assembly. Snap finger (not shown) can be provided on one or more of the components. Since each lever member 140, 160 has a small rotational range of operation, the snap fingers or features can be located at the lower ends of the ranges of operation.

While the invention has been described in connection with one or more embodiments, it is to be understood that the specific mechanisms and techniques which have been described are merely illustrative of the principles of the invention. Numerous modifications may be made to the methods and apparatus described without departing from the spirit and scope of the invention as defined by the appended claims.

What is claimed is:

1. An electronic throttle control assembly comprising:

a housing;

an air passageway in said housing;

a throttle shaft member rotatably positioned in said housing and extending through said air passageway;

a throttle plate member attached to said throttle body shaft and positioned in said air passageway;

said throttle plate member rotatably between a first position preventing air from passing through said air passageway and a second position allowing a full compliment of air to pass through said air passageway;

a motor positioned in said housing having a rotatable motor shaft;

a gear assembly positioned in said housing, said gear assembly comprising a first gear member attached to said motor shaft, a second gear member attached to said throttle shaft member, and a third gear member operably positioned between said first and second gear members;

wherein operation of said motor rotates said throttle plate between said first position and said second position;

a default mechanism positioned on said housing, said default mechanism comprising a main lever member, a main spring member, a default lever member having an arm member and a default spring member;

a contact member on said third gear member positioned to contact said arm member on said default lever member;

said main spring member positioned between said main lever member and said second gear member, said first spring member biasing said throttle shaft member away from said second position and toward said first position;

said default spring member positioned between said main lever member and said default lever member;

said default spring member biasing rotation of said throttle body shaft toward a third position of said throttle plate between said first and second positions;

wherein in the event of failure of said motor, said throttle plate will be rotated to said third position and allow limited passage of air through said air passageway.

2. The throttle control assembly of claim 1 wherein said default mechanism further comprises a stop screw member for adjusting the third position of said throttle plate.

3. The electronic throttle control assembly as set forth in claim 1 comprising electronic means for operating said motor member.

4. The electronic throttle control assembly as set forth in claim 3 further comprising a cover member on said housing, at least a portion of said electronic means being positioned in said cover member.

5. The electronic throttle control assembly as set forth in claim 1 wherein said main spring member is a helical torsion spring member.

6. The electronic throttle control assembly of claim 1 further comprising a stop member on housing, said stop member positioned to limit rotation of said gear mechanism and thus said shaft member.

7. The valve assembly of claim 1 wherein said contact member on said third gear member is a post member.

8. A valve assembly comprising:

a housing;

a fluid passageway in said housing;

a shaft member rotatably positioned in said housing and extending through said fluid passageway;

a valve member positioned in said fluid passageway, said valve member attached to said shaft member and rotatable therewith;

a gear mechanism for rotating said shaft member between a first position in which said valve member is oriented to allow full passage of fluid in said passageway, and a second position in which said valve member is oriented to prevent fluid passage in said passageway;

a motor member operably connected to said gear mechanism for causing said gear mechanism to rotate said shaft member;

said gear mechanism comprising a first gear member operatively connected to said motor member, a second gear member operatively connected to said shaft member, and a third gear member operatively positioned between said first and second gear members;

a main spring member for biasing said gear mechanism and shaft member in a direction away from said first position and toward said second position; and a default mechanism for biasing said gear mechanism and shaft member in a direction away from said second position and to a third default position between said first and second positions;

said default mechanism comprising a default lever member, a main lever member and a default spring member;

means on said third gear member adapted to operate said default lever member;

wherein in the event of non-operation of said motor member, said main spring member and default mechanism act to position said shaft member in said third position.

9. The valve assembly of claim 8 further comprising electronic means for operating said motor member.

10. The valve assembly of claim 9 further comprising a cover member on said housing, at least a portion of said electronic means being positioned in said cover member.

11. The valve assembly of claim 8 wherein said main spring member is biased between said second gear member and said main lever member.

12. The valve assembly of claim 11 wherein said main spring member is a helical torsion spring member.

13. The valve assembly of claim 8 wherein said default spring member is biasingly positioned between said main lever member and said default lever member.

14. The valve assembly of claim 8 further comprising a stop member on housing, said stop member positioned to limit rotation of said gear mechanism and thus said shaft member.

15. The valve assembly of claim 8 wherein said default mechanism further comprises an adjustable stop member for adjusting the third position of said throttle plate.

16. The valve assembly of claim 8 wherein said means on said third gear member comprises a post member.

* * * * *